United States Patent [19]

Cassiers et al.

[11] 4,245,023

[45] Jan. 13, 1981

[54] METHOD FOR THE DEVELOPMENT OF ELECTROSTATIC CHARGE IMAGES

[75] Inventors: Paul M. Cassiers, Mortsel; Willy G. Verlinden, Edegem, both of Belgium

[73] Assignee: AGFA-GEVAERT N.V., Mortsel, Belgium

[21] Appl. No.: 432,036

[22] Filed: Jan. 9, 1974

[30] Foreign Application Priority Data

Jan. 10, 1973 [GB] United Kingdom ..... 1411/73

[51] Int. Cl.[3] ..... G03G 15/10

[52] U.S. Cl. ..... 430/118; 118/661; 355/10

[58] Field of Search ..... 117/37 LE; 355/10, 15; 101/167, 425; 118/637, DIG. 23, 661; 96/1 LY; 427/15; 430/117, 118

[56] References Cited

U.S. PATENT DOCUMENTS

| | | | |
|---|---|---|---|
| 2,991,754 | 7/1961 | Johnson | 117/37 LE |
| 3,084,043 | 4/1963 | Gundlach | 117/37 LE |
| 3,276,896 | 10/1966 | Fisher | 117/37 LE |
| 3,292,572 | 12/1966 | Brenneisen et al. | 118/1 |
| 3,305,459 | 2/1967 | Smith et al. | 204/18 |
| 3,377,913 | 4/1968 | Grant | 88/24 |
| 3,383,209 | 5/1968 | Cassiers et al. | 96/1.3 |
| 3,405,683 | 10/1968 | Jons et al. | 118/637 |
| 3,667,428 | 6/1972 | Smith | 118/637 |
| 3,667,841 | 6/1972 | Ross | 96/1.2 |
| 3,685,907 | 8/1972 | Sato et al. | 355/17 |
| 3,774,574 | 11/1973 | Sato et al. | 118/DIG. 23 |
| 3,830,199 | 8/1974 | Saito et al. | 118/DIG. 23 |
| 3,851,964 | 12/1974 | Smith et al. | 118/DIG. 23 |
| 3,854,977 | 12/1974 | Fukushima | 118/DIG. 23 |
| 4,161,360 | 7/1979 | Smith | 118/661 |

*Primary Examiner*—Ralph S. Kendall
*Attorney, Agent, or Firm*—William J. Daniel

[57] ABSTRACT

A process of producing a liquid image, wherein an insulating material bearing an electrostatic charge pattern detectable at its surface is developed by wetting with a developing liquid according to such charge pattern and in which process developing liquid is brought substantially uniformly in close proximity to or in contact with the material with at least two developing liquid applicator means, which are disposed in succession along the path followed by the material and which supply developing liquid to the material in such a way that the liquid image is gradually built up by amounts of liquid offered by such successive applicator means.

13 Claims, 8 Drawing Figures

METHOD FOR THE DEVELOPMENT OF ELECTROSTATIC CHARGE IMAGES

This invention relates to a method and apparatus for the development of electrostatic charge patterns.

From the United Kingdom Pat. Specification No. 1,020,505 a process for developing electrostatic charge patterns is known according to which liquid is deposited on a hydrophobic surface of an electrostatic charge carrier bearing an electrostatic charge pattern detectable at such surface, by establishing contact or close proximity between such surface and a liquid supply means comprising at least one capillary recess or passage in which a quantity of an aqueous liquid medium (which may be water alone) by which such surface is normally substantially unwettable is held so that under the influence of the electrostatic charges borne by the carrier liquid medium is attracted from the capillary recess(es) or passage(s) and deposits on and wets the surface in accordance with the charge pattern.

In the United Kingdom Patent Specification No. 987,766 a "wetting development" process has been described according to which aqueous developers are used whose wetting angle (contact angle) is greater than 90 degrees at the uncharged areas of the electrostatic charge carrier and smaller than 90° at the charged areas to be wetted.

From the United Kingdom Pat. Specification No. 1,020,503 it is further known to use an electric field in superposition to the charge carrier during development. According to a particular embodiment a direct current voltage is applied between the developing liquid and the charge carrier to be developed. The use of a field direction opposite to that of the charged carrier increases the image-contrast, whereas an electrostatic field of a same direction as that of the charge carrier reverses the image.

In the prior art wetting development processes the developing liquid is either brought into contact with or is in close proximity to (within the distance of electrostatic attraction) the electrostatic charge carrier.

According to a particular wetting development process the developing liquid is supplied to the electrostatic charge carrier with only one applicator roller whose applicator surface is covered with such an amount of liquid that a liquid bead (liquid meniscus) is formed between the applicator surface of the roller and the charge carrier. According to that process the developing liquid is brought into contact with the charged as well as with the uncharged areas of the charge carrier. The applicator surface of the applicator roller is smooth or provided with capillary recesses, e.g. grooves. In the latter case the capillary recesses are filled up with an excess of developing liquid so that the tops or crests, i.e., lands, of the recesses are covered thereby.

According to another wetting development process the developing liquid is supplied with only one applicator roller having in its applicator surface capillary recesses, e.g. grooves in which the developing liquid is sucked up by capillarity whose tops or crests are free or freed from developing liquid, which is supplied within the attraction distance of the electrostatic charge pattern of the charge carrier and image-wise deposited thereon.

Since the wetting development technique operating with uninflammable, odourless liquids has definite advantages over other known liquid developing techniques such as electrophoretic development, great interest exists in optimizing the developing results obtainable with this technique. It has been established experimentally that although quite satisfactory results have been obtained already, e.g. by operating along the lines described in the above mentioned prior art, still further improvements are required with respect to the uniformity of applying the developing liquid and the rendering of fine image details. In the developing process operating with only one applicator roller, e.g. a "smooth-surface" roller or "capillary-surface" roller, the charge carrier material is supplied with an amount of developing liquid that is normally in excess for the charged area of large size whereas the small charged area, e.g. thin lines, receive too little developing liquid so that image detail rendering has still to be improved.

In the developing process operating with only one grooved applicator roller containing the developing liquid in the groove or grooves the recording material is supplied with developing liquid in correspondence with the groove pattern so that details in the image coinciding with the walls of the roller between adjacent grooves may not be developed and a line-wise trace of the grooves is reproduced in the image pattern.

There has now been found an improved process for the production of a liquid image by wetting development of a material carrying an electrostatic charge pattern with a developing liquid supply means in which the improvement resides in bringing developing liquid substantially uniformly in close proximity to and/or in contact with the material, with at least two developing liquid applicator means, which are disposed in succession along the path followed by the material and which supply developing liquid to the material in such a way that the liquid image is gradually built up by amounts of liquid offered by such successive applicator means.

The process may operate with two or more successive applicator rollers or other applicator means, which considered in the direction of the course followed by the charge carrier are provided with decreasing amounts of developing liquid, the level density of the developed liquid image being thereby gradually built up and the deposition of developing liquid being better kept under control.

A way to achieve the gradual building up of the liquid image is by the use of developing liquid applicator rollers of different diameter, which rollers operate at substantially the same angular speed so that decreasing amounts of developing liquid are supplied to the charge carrier material passing by.

Another way to achieve the gradual building up of the liquid image is by the use of developing liquid applicator rollers revolving at different speeds so that the different rollers carry different amounts of developing liquid to the charge carrier material.

Another way to achieve the gradual building up of the liquid image by wetting development includes the step of bringing developing liquid substantially uniformly in close proximity to and/or in contact with the carrier by means of a plurality of rotatable applicator rollers, which are disposed in succession along the path followed by the carrier and wherein the cylindrical surface of the rollers is provided with capillary passages or recesses containing developing liquid, and having at least two successive roller applicators with capillary liquid-holding openings, recesses, grooves or the like arranged so that zones of the carrier material that do not come directly opposite a quantum or quanta of liquid held by one roller came directly opposite a quantum or quanta of liquid held by a succeeding roller. The invention also includes apparatus for use in performing a process according to the invention as hereinbefore defined.

For the purpose of that embodiment the rollers are provided with capillary passages or recesses whose openings towards the material to be developed are staggered i.e. whose surface recesses or openings of at least two applicator rollers in the development operation do not match or only partly match with a corresponding zone of said material.

Although for operating along the lines of the above embodiments preference is given to applicator rollers having a capillary groove or grooves, the surface of the applicator roller(s) may be smooth or obtain capillarity by any method known in the art and the form of the capillaries may be of any type. The rollers may be made of metal, e.g. iron, bronze, copper, silver and aluminium, and plastic materials whose surfaces may be treated or coated with another material to confer appropriate wetting properties, i.e. adhesion for the developing liquid.

Applicator rollers having capillary recesses openings or channels may be obtained, e.g., by turning, milling, engraving or etching.

The geometric form of capillaries is not critical. For example the capillaries may be conical, rectangular, cylindrical, semi-spherical or irregular.

According to a special embodiment each applicator roller contains capillary grooves that are substantially perpendicular to the axis of revolution of the roller. Each applicator roller may contain one or more similar or different helical groove(s) of non-interconnecting grooves associated in parallel relationship. The non-interconnecting grooves may be inclined to the axis of revolution of the roller.

According to a preferred embodiment the supply of developing liquid to the charge-carrying material proceeds with a plurality of, preferably two or three, rotatable grooved applicator rollers, the grooves of at least two of them not being in alignment.

The applicator rollers need not be identical neither in size nor in their structure including their composing material(s). Thus, e.g., the surface structure of different rollers and/or their diameter and/or the material(s) from which they are made of may be different. For example, when grooved rollers are used the grooves may be of different width and/or depth and when applicator rollers with a helical groove are used the grooves may be of varying pitch. The depth and the width of the grooves is preferably in the range of 0.01 to 1 mm.

In a particular embodiment at least one of the liquid applicator rollers has a screened surface. Such screen may be a line screen or screen consisting of small capillary holes of same or variable depth and area on the different applicator rollers. According to such particular embodiment at least one roller is used, which is set with a multiplicity of capillary recesses distributed so that they are not arranged in spaced rows running normally to the axis of the roller.

Capillarity acts as a kind of restraining force against which electrostatic charge attraction (coulomb force) has to operate when the developing liquid is brought in contact with or in close proximity (within the attraction distance) of the electrostatic charge pattern of the recording material. The imposition of such a restraint leads to better image definition and such restraint according to a particular embodiment is different for both or for a number of or for all of the applicator rollers. Such makes it possible to have the strongest restraining force at the first roller so that with that roller only the most strongly charged areas are developed and with another roller or rollers exerting a less high restraining force, development of the less strongly charged area can take place. The restraining force depends i.a. on the wettability of the applicator roller surface, the surface tension of the developing liquid, the electrical polarizability of the developing liquid and the voltage applied between the developing liquid and the developable material.

According to a preferred embodiment the crests or tops of the capillary passages or recesses, e.g. grooves, before contact with the material to be developed, are freed from developing liquid with a doctor-knife or other cleaning means, e.g. squeegee rollers, so that images with a particularly clean image background are obtained. The tops or crests, i.e., lands, of the capillary passages or recesses, e.g. grooves, of the applicator rollers may likewise be kept free from developing liquid by using capillaries whose deep parts consist of hydrophilic material, e.g. chromium, and the high parts or tops consist of hydrophobic material, e.g. copper (see for such technique the United Kingdom Patent Specification No. 1,020,505). Both embodiments of non-wettable tops and cleaning means may be combined.

Preferred embodiments with respect to the arrangement of the applicator rollers in an apparatus in which wetting development of electrostatic charge patterns can be carried out according to the present invention are illustrated in the accompanying schematic drawings.

It should be understood that in these figures some dimensions are greatly exaggerated or the right relative dimensions are not represented in order to bring out the details of the construction.

Figure 1:
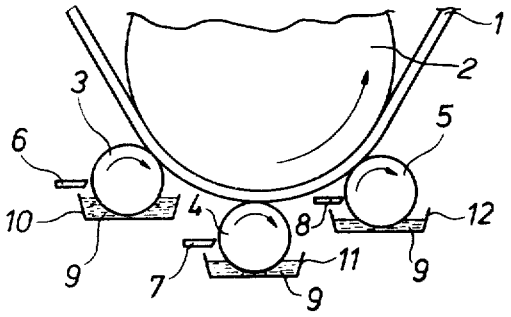
FIG. 1 is a cross-sectional representation of a developing station of the present invention.

In FIG. 1 the charge pattern bearing member 1 is fed between a pressure roller 2 and three grooved applicator rollers 3, 4 and 5 whose grooves are not in alignment and each of which is provided with a metering knife (knives 6, 7 and 8 respectively). Each applicator roller takes up developing liquid 9 from a separate trough. Trough 10 is associated with the first applicator roller 3 and roller 3 is immersed to a larger extent in the developer liquid in that trough than the rollers 4 and 5 are in their respective troughs (11 and 12). Roller 5 is immersed in trough 12 to a lesser extent than roller 4 in the liquid in trough 11.

Figure 2:
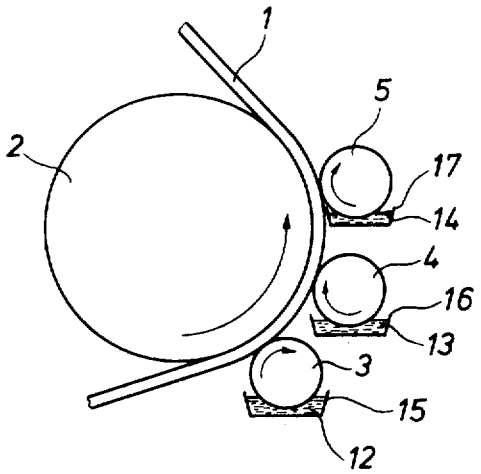
FIGS. 2 to 6 are cross-sectional representations of other developing stations.

In FIG. 2 the member 1, which carries the electrostatic charge pattern, is fed between the pressure roller 2 and the applicator rollers 3, 4 and 5 respectively. The roller 3, which has a smooth wettable surface, revolves in the developing liquid 12 present in the trough 15 and forms a liquid meniscus (not shown) with the member 1. The roller 4, which has a surface with parallel non-interconnecting grooves, revolves in the developing liquid 13 contained in the trough 16 whereas the helically grooved roller 5 revolves in the developing liquid 14 present in trough 17. The diameter of the rollers 3, 4 and 5 is the same. The angular speed of the rollers 3, 4 and 5 is different.

Figure 3:
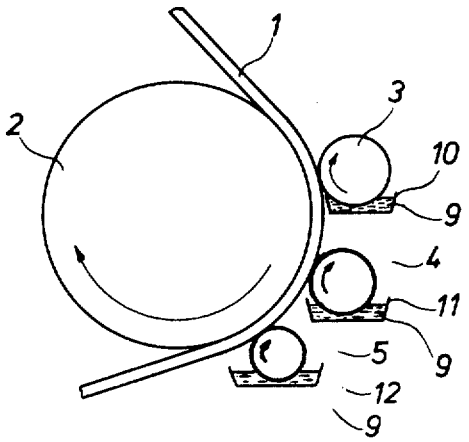

In FIG. 3 the member 1, which carries the electrostatic charge pattern, is fed between the pressure roller 2 and three applicator rollers 3, 4 and 5 that are disposed at different heights and revolve in the developing liquid 9 in the troughs 10, 11 and 12 respectively.

The sense of rotation of the pressure roller 2 and the applicator rollers 3, 4 and 5 is the same so that the pressure exerted upon the member 1 may not be too high, in other words friction may not be so high that the conveying of the member 1 between the pressure roller 2 and applicator rollers 3, 4 and 5 be stopped. The diameter of the applicator rollers is different but their angular speed is the same. The rollers form a liquid bead with member 1.

According to a modified embodiment the arrangement of FIG. 3 is adapted in such a way that the applicator rollers 3, 4 and 5 are kept just out of contact with the member 1 and revolve at such a speed that liquid is ejected by centrifugal force from the capillary passages or recesses of the roller surface onto material 1.

By the fact that the applicator rollers 3, 4 and 5 are of decreasing diameter and have the same angular speed the amount of liquid supplied to the member 1 decreases from applicator roller 3 to roller 5.

Figure 4:
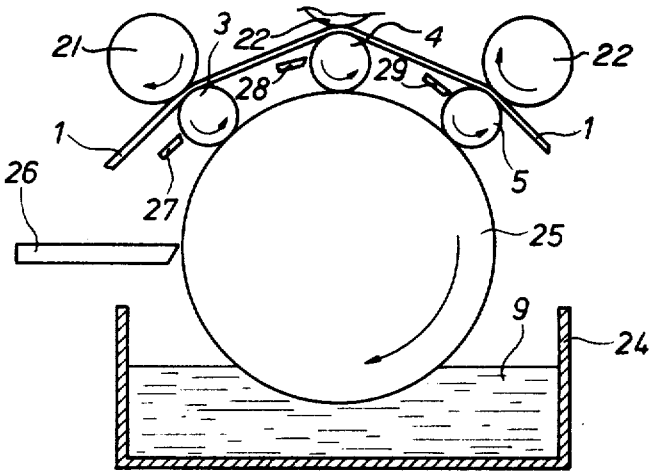

In FIG. 4 the member 1, which carries the electrostatic charge pattern, is fed between the pressure rollers 21, 22 and 23 in contact with the developing rollers 3, 4 and 5, which take up developing liquid 9 from trough 24 via a supplying roller 25 provided with a metering knife 26. Each developing roller has its own metering knife viz. 27, 28 and 29 respectively, so that with each applicator roller a different amount of liquid can be offered to the member 1.

Figure 5:
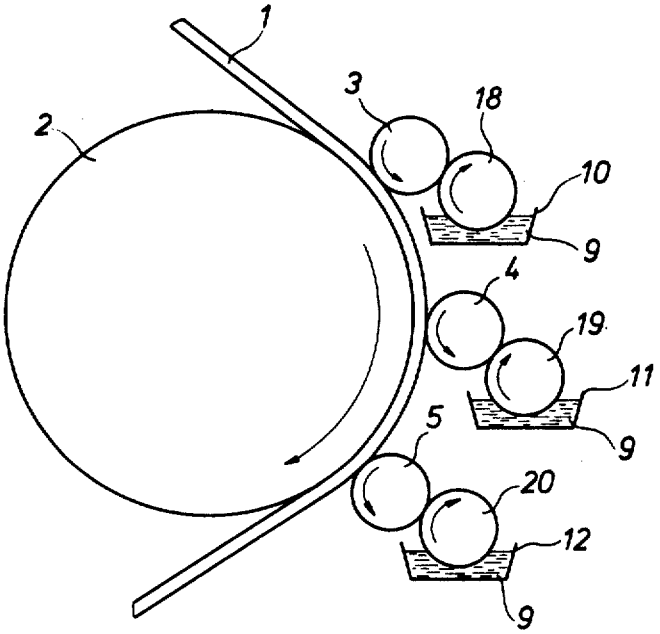

In FIG. 5 the charge-bearing member 1, which carries the electrostatic charge pattern is fed between the pressure roller 2 and three developing rollers 3, 4 and 5 positioned in descending order. The developing rollers have capillary grooves that are in staggered position and are of different depth whereby the supply of developing liquid 9 to member 1 decreases from roller 3 to roller 5.

The developing liquid 9 is applied to the respective developing rollers by means of the supply rollers 18, 19 and 20 from the corresponding troughs 10, 11 and 12. A motor and cog wheel transmission (not shown) drive the corresponding supply and developing rollers, the transmission ratio being 1:1. Optionally each of a number of the developing rollers is provided with a squeegee roller not shown in the FIG. 5 but mounted in a way as illustrated in FIG. 1 of the United Kingdom Patent Specification No. 1,000,397.

Figure 6:
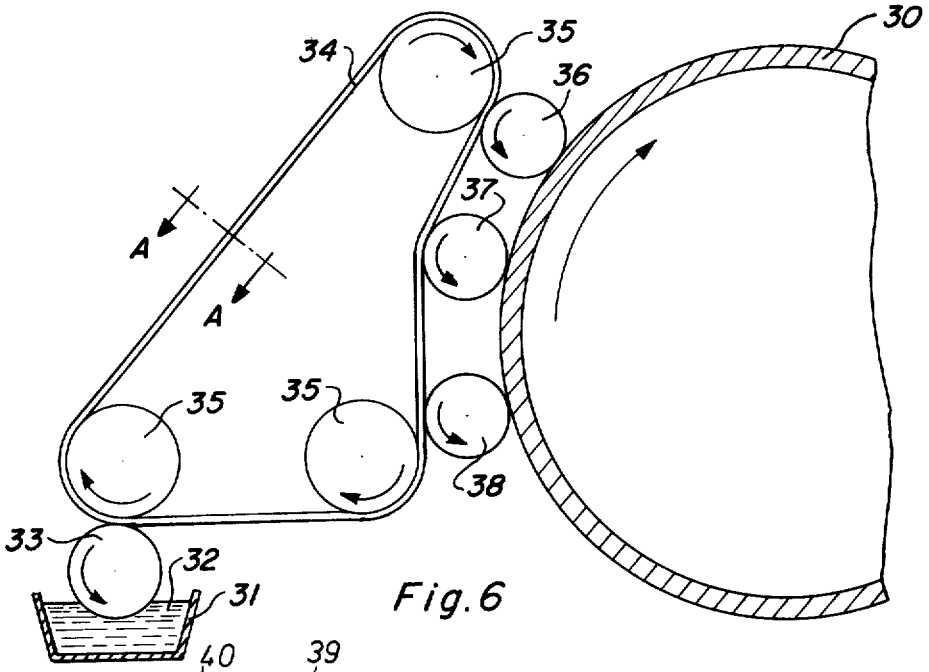

In FIG. 6 the charge-bearing member 30 is a photoconductive recording drum of a continuously operating xerographic copying machine. The drum includes generally a metal or other electrically conductive support member coated with a photoconductive insulator such as selenium or a layer of a photoconductive pigment in a suitable insulating binder. Positioned around the xerographic drum is a charging electrode, e.g. a high-voltage corona discharge electrode adapted to supply ions or electric charges to the xerographic drum surface. At an exposure station an image to be reproduced is projected onto the drum surface with a lens system desirably operating in conjunction with slot exposure mechanisms synchronized to the motion of the drum. The developing station (shown in FIG. 6) operates with one liquid supply trough 31 containing developing liquid 32, which is taken upwards by a supply roller 33 to an endless liquid-supplying belt 34. A suitable series of guide rolls 35 guide the belt in pressure contact with the developing liquid applicator rollers 36, 37 and 38 that are provided with capillary recesses or passages and take up ink from the liquid supplying belt 34 in degressive order from rollers 36 to 38.

Figure 7:
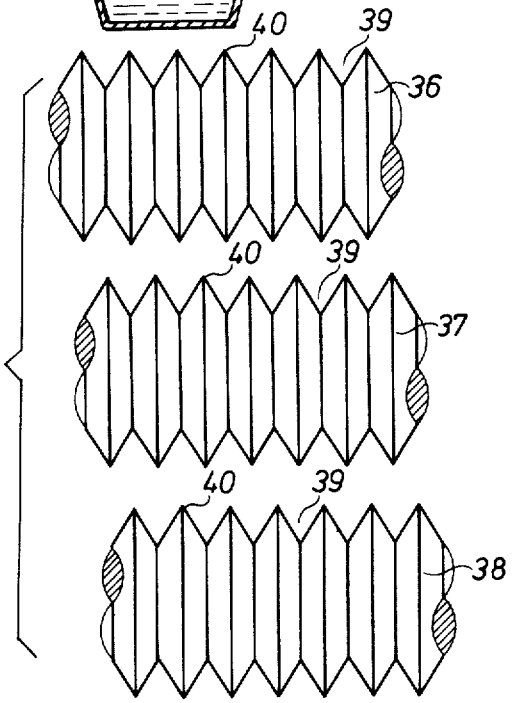
FIG. 7 is an illustration of the way how the grooves of various grooved applicator rollers are out of alignment.

The applicator rollers 36, 37 and 38 as shown in FIG. 7 are grooved rollers containing parallel non-interconnecting grooves 39.

The grooves 39 and crests or lands 40 of the rollers 36, 37 and 38 are not in alignment so that each area of the drum 30 comes into a position corresponding with the liquid fill of a groove.

Figure 8:
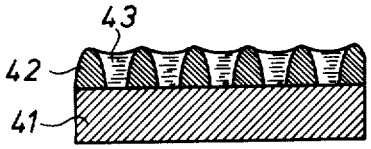
FIG. 8 is a cross-sectional representation of an applicator web used in the liquid supply to the applicator rollers of FIG. 6.

The supplying belt 34 according to one embodiment is a weblike material such as of a driving belt, which is coated at its external side with a porous material (spongelike material e.g. foamed rubber) from which liquid can be dispensed by exerting pressure thereon. According to another embodiment illustrated in FIG. 8, which is a cross-sectional view on the section A-A' an alternative form of endless belt 34, the belt comprises a support base 41 having disposed on its surface a pattern of raised dots or ridges 42 onto which the developer ink 43 adheres by capillarity which means that the walls of the dots or ridges 42 are wettable by the developing liquid.

Following the applicator roller 36 represented in FIG. 6 there is a transfer station (not shown in that FIG. 6) at which a suitable transfer web of paper or the like, which feeds from a supply roll to a take-up roll, passes between the xerographic drum 30 and a transfer roller.

Since in the developer device of the present invention a liquid is used as developer material and a liquid image is formed, transfer by pressure alone is generally satisfactory but, when the liquid has to move upwardly against gravity or rather strongly adheres to the charge-carrying member then an additional force, e.g. resulting from an electric field applied between the charge carrying member and the rear side (with electrode) of the receiving material, may be employed to help the transfer of developing liquid to the receiving material by electrostatic attraction.

After transfer of the developing liquid the surface of the drum 30 moves past a cleaning station (not shown in FIG. 6) where residual developer material, if any, may be removed from the drum surface to prepare the drum for a next imaging operation.

When in the developing stations of the present invention grooved developing rollers are used, they have preferably a rather small diameter, e.g. in the range of about 5 to about 25 mm.

As already explained in connection with the United Kingdom Patent Specification No. 1,020,503 it is possible to control the wetting development by applying a superimposed additional electric field between the developing liquid and the member carrying the charge pattern. The use of an additional field with a direction opposite to that of the charge pattern increases the image contrast, whereas an additional field with a direction being the same as that of the charge pattern may result in image reversal. In the latter case the internal electric polarization of the dielectric charge-carrying member under the influence of the additional electric field is probably responsible for the wetting of the recording member portions that do not contain a surplus charge image (externally applied charge).

The developing process and apparatus of the present invention may be applied in the wetting development of any kind of member carrying an electrostatic charge pattern.

The expression "electrostatic charge pattern" is used broadly to include any distribution of charges within a support area such that different parts of this area are charged to different extents or such that some parts only are charged. Thus, the expression includes, e.g., electrostatic images of reading matter, diagrams, pictures, etc., and charges constituting the electrostatic record of wireless or other electric signals.

The particular method by which the electrostatic charge pattern is formed is not in any way crucial. By way of example the charge pattern may be obtained by electrographic or electrophotographic processes.

In electrographic recording techniques electrostatic charges are produced on dielectric surfaces in a variety of patterns or configurations with either electric discharge or electric current or image-wise or signal-wise deposition of charged particles, e.g. electrons and/or ions. For example, an insulated pencil with a metallic point can be used to write or draw invisible electrostatic images on a dielectric film if sufficient voltage is applied to the metallic point.

A survey of electrographic processes known as electrostatic printing and facsimile reproduction has been given by R. M. Schaffert, in the book "Electrophotography," The Focal Press, London and New York (1965), 111-123 and in the book "Xerography and Related Processes" edited by John H. Dessauer and Harold E. Clark—The Focal Press—London and New York (1965) 439-460.

The recording material used in electrography is, e.g., a web consisting of an insulating coating of plactic on a paper base having sufficient conductivity to allow electric charge to flow from a backing electrode to the paper-plastic interface.

A review of the production of electrostatic charge images by electrophotography has been given by Robert B. Comizzoli, Gerald S. Lozier and Donald A. Ross in the Proceedings of the IEEE, Vol. 60, No. 4, April 1972, pages 348-369. From that review can be learned that in electrophotography the recording element contains or consists of a photoconductive member or is a photo-emissive member. Onto or into such member or onto a charge-receiving or -collecting insulating member associated therewith an electrostatic charge pattern is formed.

The most commonly used form of electrophotography is based on the development of a latent electrostatic image on an overall precharged and image-wise exposed insulating photoconductive layer. The photoconductive layer may be coated on a drum (e.g. selenium drum) from which the developing substance deposited in the charged areas is transferred to a receiving member, e.g. sheet of paper.

In order to avoid the need to transfer the developer substance to a receiving member the photoconductive layer may be directly coated on a sheet or weblike material, e.g. paper, on which the developed and fixed print is formed. In the latter process the photoconductive layer contains commonly white photoconductive zinc oxide particles dispersed in an insulating binder layer on paper serving as support.

For developing the electrostatic charge pattern a liquid medium is used, which does not normally wet the surface of the charge carrying member, or not to any appreciable extent, but which will wet such surface under the influence of the encountered electrostatic attractive charges so as to record the electrostatic charge pattern in terms of surface wetting. In the interest of forming good quality records it is preferable that the electrostatic charges are capable of reducing the contact angle between the liquid and the charged surface to such an extent that complete surface wetting occurs (contact angle of 0° or approximately so).

The members carrying a charge pattern have in non-charged state preferably such surface properties that the developing liquid forms a contact angle preferably larger than 100°. For a definition of "contact angle" see I. Alexander, Colloid Chemistry, Vol. I, Principles and Applications, 4th Ed., D. van Nostrand Company, Inc., New York, p. 79-80.

Preference is given to aqueous developing liquids. When such liquids are used the members carrying a charge pattern have to be hydrophobic in their non-charged state (contact angle preferably larger than 100°).

The developing liquid is preferably highly polarizable so that liquids with dielectric constant of at least 30 are particularly preferred. Water, as is generally known has a dielectric constant of 80. Useful organic liquids with "high" dielectric constant are, e.g., methanol, ethanol, glycerol, formamide and dimethylformamide. The developing liquid may be electrically conductive, e.g. has a resistivity lower than $10^6$ ohm.cm.

Water alone or water containing at least one other ingredient (e.g. organic polar liquid) may be used as developing liquid provided that the composition as a whole has the requisite properties referred to. In general it is preferred to use in the developing liquid at least 60% by weight of water. The developing liquid may be a solution or a dispersion (suspension or emulsion). Conductive developing liquids normally contain free ions, e.g. of dissolved salts.

A survey of suitable developing liquids for wetting development is given in the United Kingdom Pat. Specifications Nos. 987,766 - 1,020,503 - 1,020,505 - 1,032,264 - 1,068,472 and 1,068,473.

According to a preferred feature in the developing process of the present invention a photoconductive layer with hydrophobic properties is used as carrier for the electrostatic charge pattern. Preferably the photoconductive layer comprises a photoconductive dispersed in an insulating binding agent. The usual photoconductive layers, which comprise organic or mineral photoconductive substances dispersed in an insulating polymeric binding agent, and the photoconductive layers, which comprise organic photoconductive polymers, possess a hydrophobic character.

Electrophotographic recording layers that are particularly suitable for wetting development with aqueous developing liquids are described in the United Kingdom Pat. Specifications Nos. 987,766 - 1,020,503 and 1,020,505.

The wettability of a surface may be influenced by the surface roughness as described in the U.S. Pat. Nos. 3,472,676 and 3,486,922. Thus, the degree of roughness or content of micro-recesses in the surface of a charge carrier, e.g. a photoconductive layer, may be influenced by suitably choosing the grain size and the degree of dispersion of the photoconductive material or by the controlled flocculation of the binding agent in some solvents.

Surface roughness can also be obtained by applying the insulating layer, e.g. photoconductive layer, in a regular or irregular screen form.

We claim:

1. In a process of developing an imagewise electrostatic charge pattern on the surface of an insulating material which comprises the steps of selectively applying to the charged surface region of said material a developer liquid with respect to which the material surface is non-wettable when uncharged but wettable when charged, said liquid being applied from a rotatable applicator roller having substantially are entirety of its surface formed as a regular pattern of closely spaced capillary developer liquid holding recesses separated by ridges, said applicator roller surface during development having its ridges in substantial contact with said material surface, the improvement of providing better control over the liquid application and avoiding imcomplete development by applying the same developer liquid to the same overall imagewise charged regions in plural successive stages by moving the material surface successively into contact with at least two of said rotatably patterned applicator rollers, the pattern of said ridges and recesses and the dispostion of said rollers relative to each other being such that the paths of the ridges on the material surface of each such roller fall essentially within the paths of the recesses of the next succeeding roller whereby the locations of the quanta of developer liquid applied to the material surfaces from the recesses of each roller are out of registration with the quanta of liquid applied from the recesses of the next succeeding roller.

2. A process according to claim 1, wherein said developing liquid applicator rollers having different diameters, which rollers rotate at substantially the same angular speed so that decreasing amounts of developing liquid are supplied to the charge carrier material passing by.

3. A process according to claim 1, wherein said developing liquid applicator rollers revolve at different speed so that the different rollers carry different amounts of developing liquid up to the charge carrier material.

4. A process according to claim 1, wherein said developing liquid applicator rollers are provided with capillary grooves whose openings towards said material are staggered.

5. A process according to claim 1, wherein said developing liquid applicator rollers are made of metal or plastic material which is wet by the developing liquid.

6. A process according to claim 1, wherein said developing liquid applicator rollers are helically grooved and the grooves of the different rollers are of varying pitch.

7. A process according to claim 1, wherein at least one of the applicator members is a rotatable roller having a screened surface.

8. A process according to claim 1, wherein the lands of the capillary recesses before contact with the material to be developed are wiped free of developing liquid.

9. A process according to claim 1, wherein the developing liquid forms a contact angle larger than 100° with the charge-carrying surface in its non-charged state.

10. The process according to claim 1 wherein said developing liquid is conductive polarizable liquid.

11. The process according to claim 1 wherein said recesses differ in size in the successive members.

12. The process according to claim 11 wherein said recesses are of progressively decreasing depth in successive members.

13. The process according to claim 1 wherein said insulating material surface is hydrophobic and said developing liquid is aqueous.

* * * * *